US006042039A

United States Patent [19]

Furuya et al.

[11] Patent Number: 6,042,039

[45] **Date of Patent: *Mar. 28, 2000**

[54] TAPE REEL DEVICE WITH BRAKE MECHANISM APPLYING CONSTANT BACK TENSION

[75] Inventors: Yoshikiyo Furuya; Chie Ohshima; Hideki Sakano, all of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/829,767

[22] Filed: Mar. 31, 1997

[30] Foreign Application Priority Data

Apr. 5, 1996 [JP] Japan ..... 8-083626

[51] Int. Cl.[7] ..... B65H 23/06; B41J 33/14

[52] U.S. Cl. ..... 242/348; 242/423.1; 242/588.6; 400/234

[58] Field of Search ..... 242/348, 343.2, 242/423.1, 423.2, 396.9, 538.3, 588, 588.6; 400/208, 234

[56] References Cited

U.S. PATENT DOCUMENTS

| | | | |
|---|---|---|---|
| 2,905,404 | 9/1959 | Simmons | 242/423.2 |
| 4,336,911 | 6/1982 | Fairchild | 242/423.1 |
| 4,360,172 | 11/1982 | Cope | 242/423.1 |
| 4,391,539 | 7/1983 | Connoy | 400/208 |
| 4,714,211 | 12/1987 | Hwang | 242/423.1 |
| 4,915,319 | 4/1990 | Gerber | 242/423.1 |
| 5,350,243 | 9/1994 | Ichinomiya | 242/615 X |
| 5,564,645 | 10/1996 | Lissoni | 242/423.1 |
| 5,595,447 | 1/1997 | Takayama et al. | 400/231 |

FOREIGN PATENT DOCUMENTS 6227103 8/1994 Japan .

*Primary Examiner*—John Q. Nguyen
*Attorney, Agent, or Firm*—Loeb & Loeb, LLP

[57] ABSTRACT

A tape reel device includes a spool in the form of a hollow cylinder having a hollow portion for winding a tape material around a peripheral surface thereof, a casing rotatably accommodating the spool, and a braking mechanism in sliding contact with the spool. The baking mechanism applies back tension to the tape material being rolled out from the spool. The braking means comprises a sliding-contact member brought into contact with the spool in an axial direction such that the spool is circumferentially slidable on the sliding-contact member, and a spring arranged within the hollow portion of the spool and supported by the casing for urging the sliding-contact member in the axial direction.

11 Claims, 6 Drawing Sheets

TAPE REEL DEVICE WITH BRAKE MECHANISM APPLYING CONSTANT BACK TENSION

BACKGROUND OF THE INVENTION

1. Field of the Invention

This invention relates to a tape reel device for winding a tape material, such as an ink ribbon, therearound, which applies back tension to the tape material when it is rolled out, and a tape cartridge incorporating the tape reel device.

2. Prior Art

FIGS. 1 and 2 show a conventional tape reel device. As shown therein, a spool 53 is arranged between an upper casing 51, a lower casing 52, such that the spool 53 has opposite ends thereof rotatably supported by the upper casing 51 and the lower casing 52, respectively, with an ink ribbon R wound therearound. The spool 53 is in the form of a hollow cylinder, with its upper end being fitted on a hollow shaft portion 54 extending from the upper casing 51 such that it is rotatably supported thereby, and its lower end rotatably supported by a bearing ring 56 seated on an annular projection formed on the bottom of the lower casing 52. In other types of the conventional device, the bearing ring 56 is omitted. The spool 53 has its upper end face in contact with a plate spring 53 fitted on the hollow shaft portion 54 whereby the spool 53 is urged by the plate spring 57 toward the bearing ring 56, i.e. downward as viewed in FIG. 1.

The plate spring 57 is in the form of a slightly deflected annulus, and sandwiched between the lower surface of the upper casing 51 and the upper end surface of the spool 53 in a strongly stressed fashion. According to this arrangement, when the ink ribbon R is pulled to be rolled out from the spool 53, plate spring 57 acts to brake the rotation of the spool 53, and at the same time apply back tension to the ink ribbon R to thereby prevent backlash of the spool 53 and loosening of the ink ribbon R.

The conventional tape reel device as described above requires the plate spring 57 to be arranged in the narrow spacing between the upper casing 51 and the spool 53, as means for braking the spool 53, so that the plate spring necessarily has a short spring stroke (amount of deflection when the spring is urged) and a large spring constant. The necessity of obtaining a predetermined spring force in the short spring stroke results in an increased deflecting load per unit stroke (i.e. spring coefficient), which means that a slight change in the amount of deflection drastically changes the urging force of the plate spring 57. Therefore, unless the flatness of the lower surface of the upper casing 51 and the flatness of the upper end surface of the spool 53, parallelism between these surfaces, and the deflection of the plate spring 57 are attained with accuracy, the urging force of the plate spring largely changes with rotation of the spool 53, causing unstable braking force of the tape reel device.

Further, the plate spring 57 per se is in contact with the upper casing 51 at two points, and in rolling contact with the spool 53 at other two points positioned outward of the two points. This construction of the tape reel device prevents uniform urging force from being applied to the spool 53. Further, if the plate spring is formed of metal, and the spool 53 and the upper casing 51 are formed of resin, the spool 53 wears as it rotates, and if the plate spring 57 freely rotates with the spool 53, the upper casing 51 wears. This also causes unstable braking force of the tape reel device. The unstable braking force causes an extremely large back tension applied to the ink ribbon R to put large load on a drive device, or an extremely small back tension applied to the same to loosen the ink ribbon R, causing an unstable feed of the ink ribbon R.

SUMMARY OF THE INVENTION

It is a first object of the invention to provide a tape reel device which is capable of applying constant back tension to a tape material rolled out therefrom without increasing the height of the casing thereof.

It is a second object of the invention to provide a tape cartridge incorporating a tape reel device which is capable of applying constant back tension to a tape material rolled out therefrom without increasing the height of the casing thereof.

To attain the first objects, according to a first aspect of the invention, there is provided a tape reel device including a spool in the form of a hollow cylinder having a hollow portion, for winding a tape material around a peripheral surface thereof, a casing rotatably accommodating the spool, and braking means in sliding contact with the spool, the braking means applying back tension to the tape material being rolled out from the spool.

The tape reel device is characterized in that the braking means comprises:

- a sliding-contact member brought into contact with the spool in an axial direction in a manner such that the spool is circumferentially slidable on the sliding-contact member; and
- a spring arranged within the hollow portion of the spool and supported by the casing for urging the sliding-contact member in the axial direction.

According to the construction of the tape reel device, the spring of the braking means axially urging the sliding-contact member is arranged within the hollow portion of the spool. Therefore, an identical urging force can be applied with a longer spring stroke and at the same time with a smaller spring constant than the prior art which employs a plate spring. That is, it is possible to reduce deflecting load per unit stroke of the spring. Therefore, it is possible to reduce variation in the urging force applied to the spool, to thereby stabilize the braking force acting on the spool. Further, since the spring is arranged within the hollow portion, it is not at all necessary to increase the height of the casing, but on the contrary, it is possible to set the spring to a sufficient length. It should be noted that "back tension" is a stress constantly applied to the tape material as a braking force acting thereon in a direction opposite to the direction of feed of the tape material to prevent the tape material from being fed to an unnecessarily advanced position.

Preferably, the braking means further includes a rotation stop mechanism for restricting rotation of the sliding-contact member.

According to this preferred embodiment, it is possible to prevent the sliding-contact member from being freely rotated with the spool, and bring the sliding-contact member receiving the urging force of the spring into sliding contact with the spool during rotation in a stable manner.

Preferably, the sliding contact member has a spring-receiving portion in the form of a hollow cylinder which is fitted in the hollow portion of the spool with play, the spring-receiving portion having a bottom and accommodating the spring, and a flange formed at an open end of the spring receiving portion, the flange being in sliding contact with an end face of the spool.

According to this preferred embodiment, since the spring is received within the spring-receiving portion fitted in the hollow portion of the spool with play, no interference occurs between the spool rotating and the spring, which prevents the braking force from being made unstable. Further, the flange in sliding contact with the end face for the spool dispenses with the need of special machining of the spool.

More preferably, the spring comprises a coiled spring, the flange being in sliding contact with the end face of the spool along the whole circumference thereof, the coiled spring being arranged in a fashion substantially coaxial with the spool.

According to this preferred embodiment, it is possible to make constant the state of sliding contact between the flange and the spool during rotation, so that the variation in friction between the flange and the spool can be reduced to thereby stabilize the braking force.

Further preferably, the rotation stop mechanism comprises an engaging portion extending from the casing into the spring-receiving portion of the sliding-contact member, and a catching member formed on the bottom for being brought into engagement with the engaging portion in a direction of rotation of the spool.

According to this preferred embodiment, no additional space is uselessly provided, and the engaging portion and the catching portion can be formed relatively simply. Further, since the engaging portion and the catching portion are engaged in the direction of rotation of the spool, it is ensured that they are engaged with each other as the spool rotates, even if they are not engaged with each other immediately after assembly work. Therefore, it is possible to save time and effort for assembling the tape reel device while positioning the engaging portion and the catching portion with respect to each other.

Further preferably, the engaging portion and the catching portion each having a tip formed like a spire extending in a direction perpendicular to the direction of rotation of the spool.

According to this preferred embodiment, even if the end of the engaging portion strikes against the end of the catching portion during assembly work, the catching portion on the sliding-contact member side shifts its position with respect to the engaging portion of the casing, which makes the assembly work less troublesome.

More preferably, the spool and the flange are formed of resin.

According to this preferred embodiment, the sliding contact of the spool and the flange of the sliding-contact member is stabilized and friction between them is minimized through sliding contact of resins from which these members are made.

More preferably, a shaft projection extending from the casing is fitted in the spring-receiving portion, the flange being in the form of an annulus coaxial with the spool, the spool having the end face formed with an annular projection which is axially rotatably supported by the flange.

According to this preferred embodiment, the spool is axially rotatably supported on the casing by the annular projection and the sliding-contact member, which stabilizes the rotation of the spool.

To attain the second object, according to a tape cartridge including a tape reel device, the tape reel device includes a spool in the form of a hollow cylinder having a hollow portion, for winding a tape material around a peripheral surface thereof, a casing rotatably accommodating the spool, and braking means in sliding contact with the spool, the braking means applying back tension to the tape material being rolled out from the spool.

The tape cartridge according to the second aspect of the invention is characterized in that the braking means comprises:

a sliding-contact member brought into contact with the spool in an axial direction such that the sliding-contact member is in sliding contact with the spool in a circumferential direction; and a spring arranged within the hollow portion of the spool for urging the sliding-contact member in the axial direction in a fashion supported by the casing.

According to the arrangement of the tape cartridge of the second aspect of the invention, tape materials as consumable articles can be removably loaded in various electronic devices and the like.

The above and other objects, features, and advantages of the invention will become more apparent from the following detailed description taken in conjunction with the accompanying drawings.

DETAILED DESCRIPTION

Now, the invention will now be described in detail with reference to drawings showing a preferred embodiment thereof. In this embodiment, the invention is applied to a tape cartridge incorporating a tape reel device, which is loaded in a tape-printing device.

The tape-printing device prints on a tape, as desired, by key entry, and cuts off a printed portion of a continuous tape. The printed portion cut off from the tape is used as a label to be attached to a document file or the like. In short, the tape-printing apparatus (hereinafter referred to as "the printing apparatus") makes a label printed with characters from a plain tape. The tape cartridge contains the plain tape and an ink ribbon as respective rolls, and the plain tape and the ink ribbon are rolled out to a print head of the printing apparatus, where printing is carried out on the plain tape by thermal transfer of ink from the ink ribbon.

Figure 1:
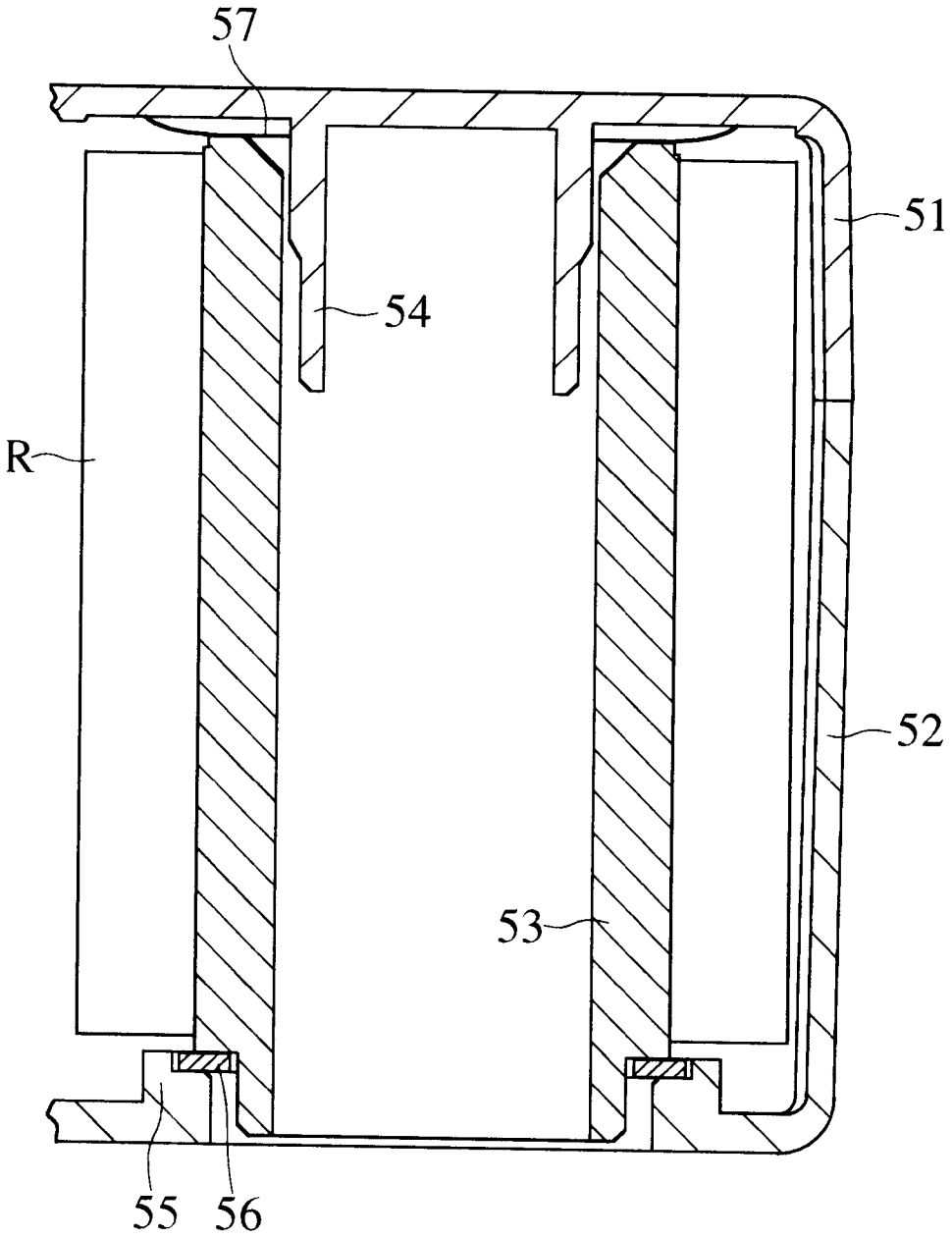
FIG. 1 (PRIOR ART)
FIG. 1 is a fragmentary longitudinal cross-sectional view of part of a tape cartridge including a conventional ribbon supply reel.
Figure 2:
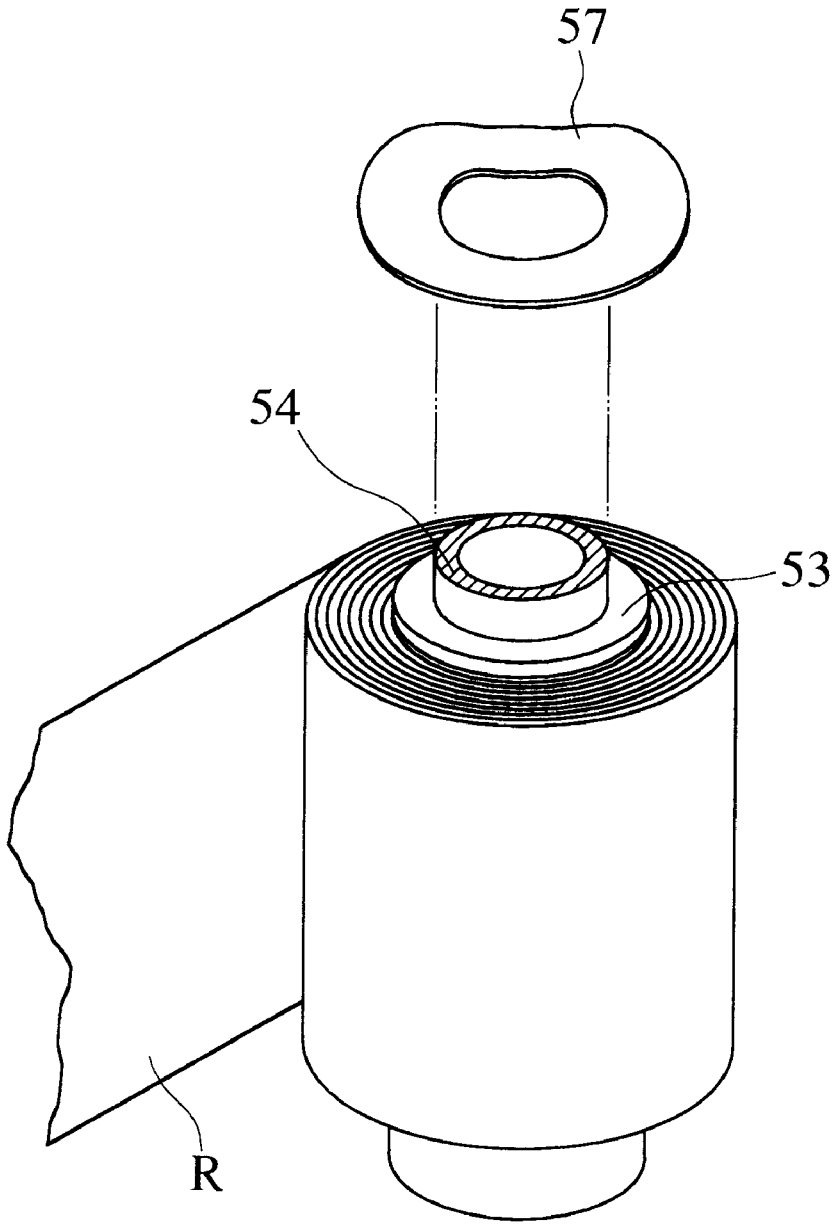
FIG. 2 (PRIOR ART)
FIG. 2 is an exploded perspective view of the conventional ribbon supply reel.
Figure 3:
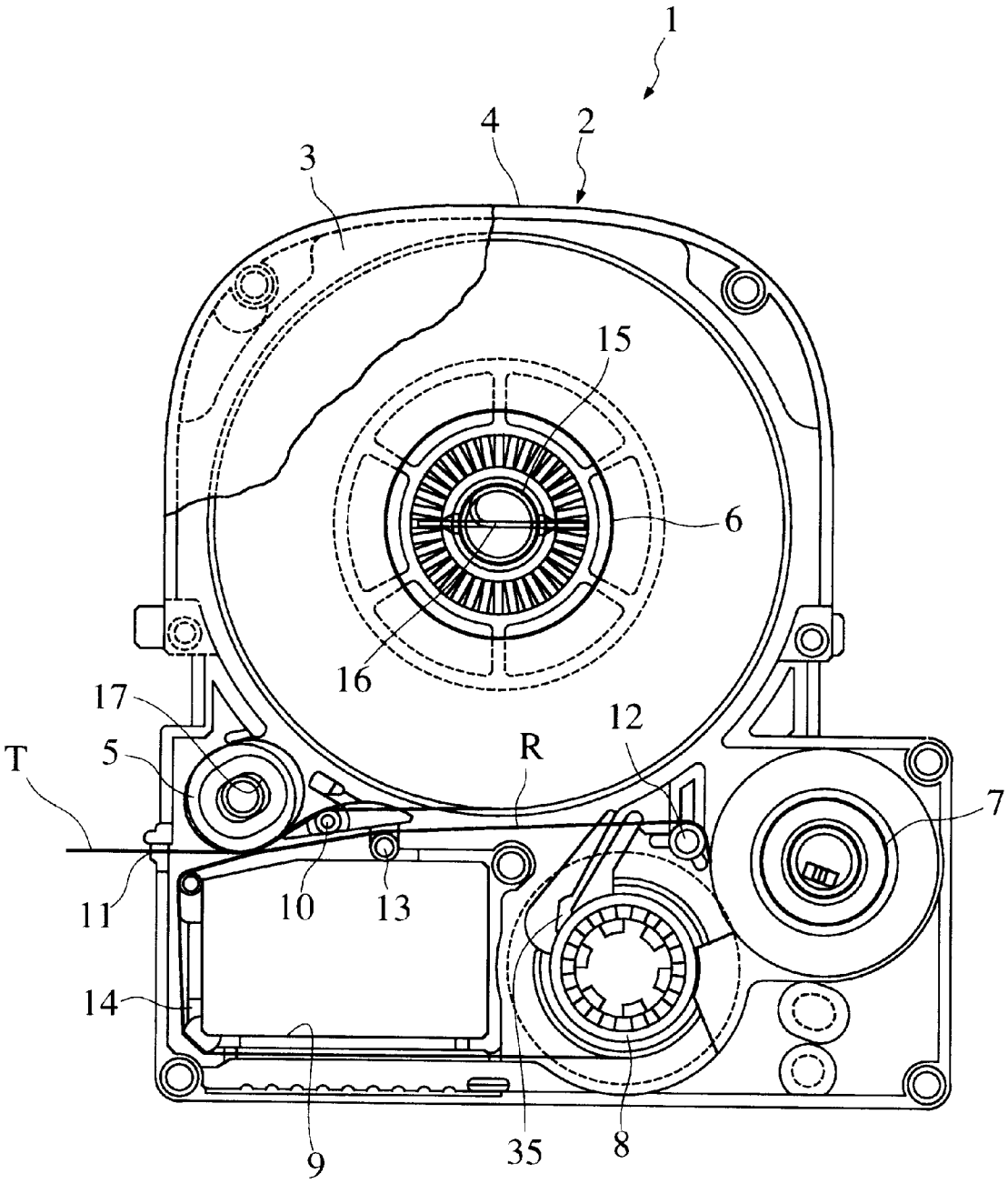
FIG. 3 is a plan view of a tape cartridge incorporating a tape reel device according to an embodiment of the invention.

FIG. 3 shows a tape cartridge 1 from which almost all of upper casing 3 is broken away. As shown in the figure, the tape cartridge 1 has a casing 2 as an assembly of the upper casing 3 and a lower casing 4, which contains a tape T and an ink ribbon R as respective rolls, and a platen roller 5 for being associated with the print head. The casing 2 also contains a tape reel 6 around which the tape T is wound, a ribbon supply reel 7 around which the ink ribbon R is wound, and a ribbon take-up reel 8 for taking up used portions of the ink ribbon R therearound, each arranged in a rotatable fashion.

On the other hand, the casing 2 is formed with an opening which is substantially rectangular in cross section and vertically extends through the casing 2. When the tape cartridge 1 is loaded in a pocket of the printing apparatus, the print head of the printing apparatus faces the opening 9 to be opposed to the platen roller 5, In the loaded state of the tape cartridge, the platen roller 5 and the ribbon take-up reel 8 are in engagement with respective drive shafts arranged in the printing apparatus. That is, the platen roller 5 and the ribbon take-up reel 8 function as driving reels, while the tape reel 6 and the ribbon supply reel 8 as trailing reels.

The tape T rolled out from the tape reel 6 is guided by a tape guide pin 10 to the platen roller 5, where it is printed, and then delivered from the tape cartridge 1 via a tape delivery slit 11 formed through a side wall of the casing 2. On the other hand, the ink ribbon R rolled out from the ribbon supply reel 7 is guided by a first ribbon guide pin 12 and a second ribbon guide pin 13 to the platen roller 5, where it is placed on the tape T to be used in this state for printing on the tape T, and then further guided by a wall 14 defining the opening 9 to make a U turn, followed by being taken up by the ribbon take-up reel 8. The platen roller 5 and the ribbon take-up reel 8 rotate in a synchronous manner, whereby the tape T and the ink ribbon R are fed simultaneously and the tape is printed while being fed. A portion of the tape T delivered from the tape delivery slit 11 is cut off by a cutter, not shown, arranged in the printing apparatus, for use as a label.

According to the tape cartridge 1 constructed as above, whenever a sequence of printing operations are carried out, the tape T and the ink ribbon R are stopped. That is, the tape T and the ink ribbon R are fed and stopped repeatedly to be rolled out from the tape reel 6 and the ribbon supply reel 7, respectively. If the tape reel 6 and the ribbon supply reel 7 are arranged in a freely rotatable fashion, there is a possibility that the tape T and the ink ribbon R are loosened to be jammed within the casing 2. Further, there is also a possibility that the tape T has its leading end pushed back through the tape delivery slit 11 into the casing 2 due to its own rigidity.

To overcome these inconveniences, for the tape T, a spring 16 is fitted on a support shaft 15 of the tape reel 6 whereby the tape reel 6 is rotated in a clicking manner, and at the same time the platen roller 5 is rotatably supported within shaft holes 17 elliptical in cross section which are formed in the upper and lower casings 3 and 4, respectively. According to this arrangement, when a force acts on the tape in a direction of retracting the tape T into the tape cartridge 1, the platen roller 5 is moved along inner walls of the shaft holes 17 toward the tape guide pin 10 whereby the tape T is caught between the tape guide pint 10 and the platen roller 5. On the other hand, for the ink ribbon R, the ribbon supply reel 7 applies back tension to the ink ribbon R.

Figure 4:
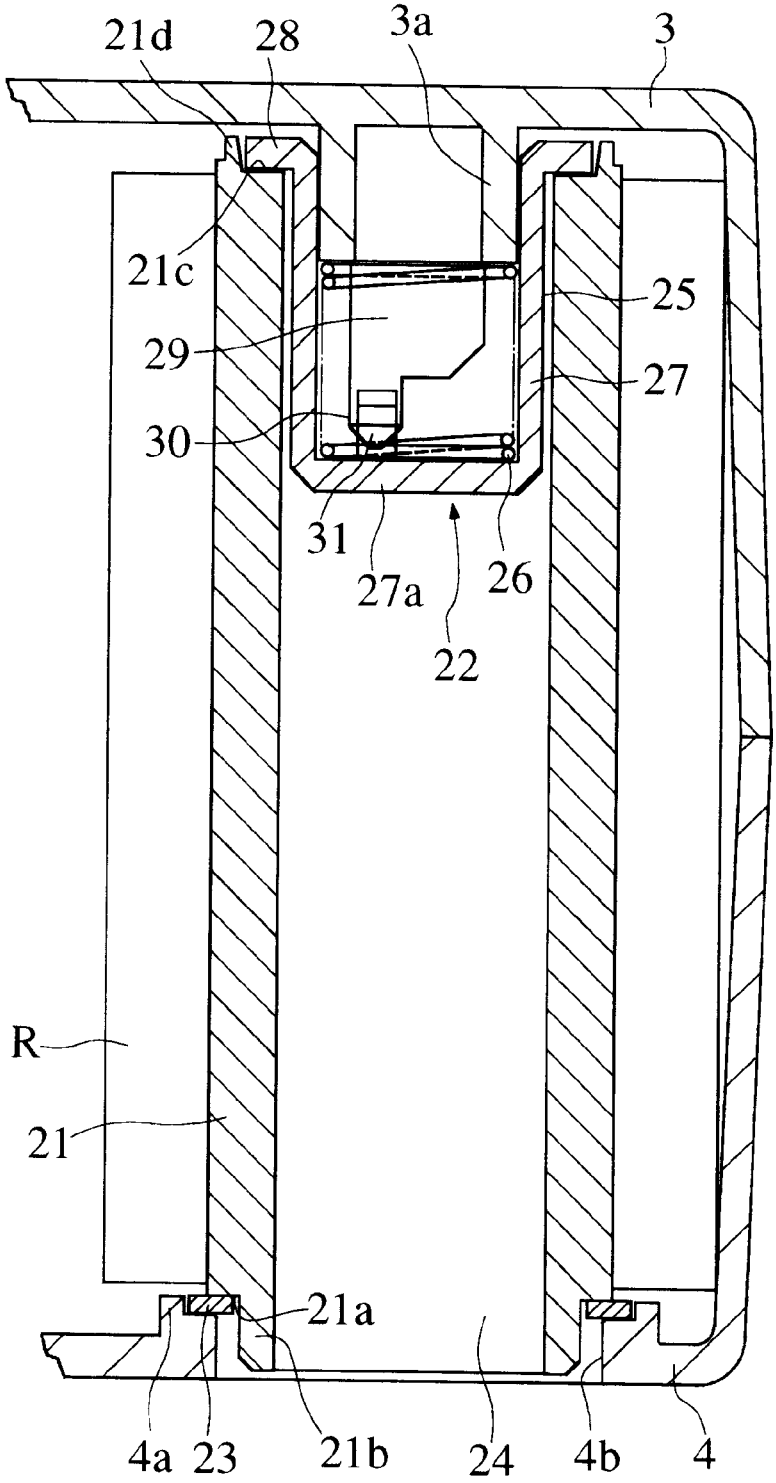
FIG. 4 is a fragmentary longitudinal cross-sectional view of part of the tape cartridge including a ribbon supply reel.
Figure 5:
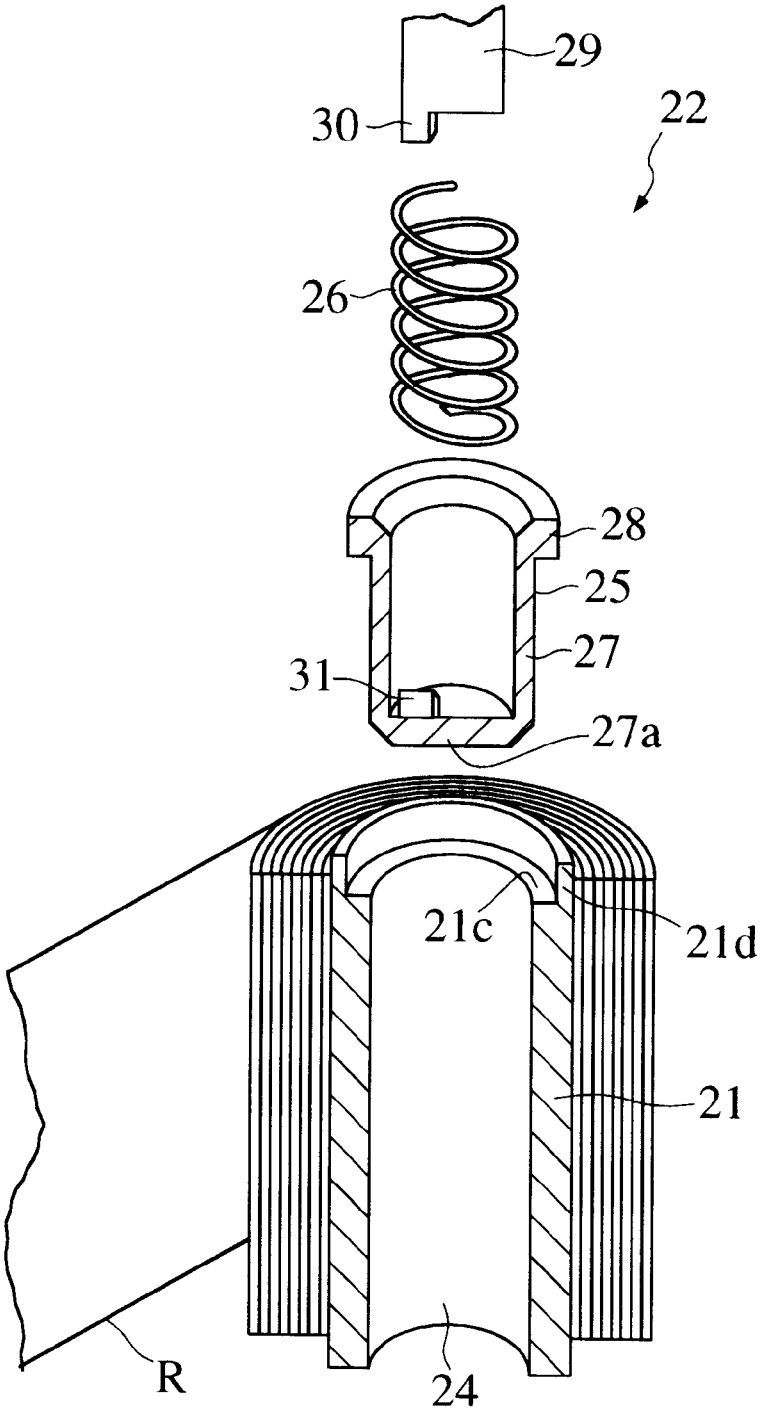
FIG. 5 is an exploded perspective view of the ribbon supply reel.

Now, the mechanism of applying back tension to the ink ribbon R will be described in detail with reference to FIGS. 4 and 5. The ribbon supply reel 7 has a spool 21 around which the ink ribbon R is wound. The spool 21 has its upper end rotatably supported via a braking device (braking means) 22 by the upper casing 3, and its lower end rotatably supported via a bearing ring 23 by the lower casing 4. The bearing ring 23 is seated on an annular projection formed on the bottom of the lower casing 4 and supports the spool 21 at a shoulder 21*a* formed around the lower end of the spool 21. It should be noted that a variation of the present embodiment can be provided in which the bearing ring 23 is omitted. A lower end portion 21*b* continuing from the shoulder 21*a* is loosely inserted in a shaft hole 4*b* formed in the lower casing 4.

The lower end portion 21*b* of the spool 21 is formed with a plurality of grooves, not shown, at circumferentially-spaced intervals, with which a resilient pawl 35 integrally formed with the lower casing 4 is brought into engagement. That is, when the tape cartridge 1 is removed from the printing apparatus 1, the resilient pawl 35 engages with one of the grooves to prevent the spool 21 from rotating, thereby preventing the ink ribbon R from being loosened during transport or storage. When the tape cartridge 1 is loaded in the printing apparatus, a projection formed on the printing apparatus bends the pawl away from the grooves, thereby placing the spool 21 into a rotatable state (permitting the ink ribbon R to be rolled out).

The braking device 22 is arranged between the upper casing 3 and the spool 21 for supporting the upper end of the spool 21, and at the same time braking the spool 21 when the spool 21 is rotated as the ink ribbon R is rolled out. The braking device 22 is comprised of a sliding-contact member 25 which is inserted into a hollow portion 24 of the spool 21, and is in contact with an upper end face 21*c* of the spool 25, and a coiled spring 26 received within the inner space of the sliding-contact member 25 for urging the same downward. The spool 21 and the sliding-contact member 25 are both formed of a resin, so as to make stable the sliding contact between them and prevent friction from occurring between them.

The sliding-contact member 25 has a spring-receiving portion 27 in the form of a hollow cylinder having a bottom at a lower end for receiving the coiled spring therein, and an annular flange 28 radially extending outward from an open upper end of the spring-receiving portion 27 for being brought into sliding contact with the upper end face 21*c* of the spool 21. The sliding-contact member 25 is arranged in a fashion coaxial with the spool 21.

The flange 28 is brought into contact with the upper end face of the spool 21 from above, and as the spool 21 rotates, it slides on the spool 21 at the whole lower surface thereof. Further, the spool 21 is formed with an annular projection 21*d* which is opposed to an outer peripheral surface of a radial end face of the flange 28 such that the annular projection 21*d* surrounds the periphery of the flange 28 with a clearance therebetween. The flange 28 and a cylindrical shaft portion 3*a*, referred to hereinafter, axially rotatably supports the upper end of the spool 21. Thus, the spool 21 is supported at both ends thereof and restricted in its horizontal position by the annular projection 21*d* and the bearing ring 23 such that it is rotatable about its axis without deflection.

The spring-receiving portion 27 is fitted on the cylindrical shaft portion 3*a* (shaft projection) which extends from the upper casing 3 in a hanging fashion, and the coiled spring 26 is arranged between a lower end face of the cylindrical shaft portion 3*a* and a bottom wall 27*a* of the spring-receiving portion 27 in a fashion urging the spring-receiving portion downward. That is, the coiled spring 26 urges the flange 28 on the upper end face 21*c* of the spool 21 by way of the spring-receiving portion 27. As described above, the flange 28 is in sliding contact with the spool 21 at the whole lower end thereof, and the coiled spring 26 received within the spring-receiving portion 27 is coaxial with the spool 21, whereby the flange 28 is urged against the spool 21 by a constant uniform force, achieving stable sliding contact between the flange 28 and the spool 21.

The cylindrical shaft portion 3*a* has a tongue 29 extending downward from a central part of a lower end thereof. The tongue 29 has an engaging portion 30 for restricting the rotation of the sliding-contact member 25. In a manner corresponding to the engaging portion 30, the bottom wall 27*a* of the spring-receiving portion 27 is formed with a catching portion 31 at an eccentric location, whereby the engaging portion 30 and the catching portion are brought into engagement with each other in a direction of rotation of the spool 21 to prevent the spool 21 from rotating. That is, the engaging portion 30 and the catching portion 31 form a rotation stop mechanism of the sliding-contact member 25 which prevents the sliding-contact member 25 from freely rotating with the spool 21.

Through prevention of free rotation of the sliding-contact member 25 by the rotation stop mechanism, the coiled spring 26 is prevented from rubbing against the spring-receiving portion 27. Further, since the engaging portion 30 and the catching portion 31 are engaged with each other in the direction of rotation of the spool 21 (i.e. in the direction of free rotation of the sliding-contact member 25), it is ensured that they are brought into engagement with each other, through free rotation of the sliding-contact member 25 with the spool 21, even if the engaging portion 30 is not engaged with the catching portion 31 when the upper casing 3 is assembled with the lower casing through inserting the tongue 29 into the sliding-contact member 25 fitted in the spool 21. In short, it is not required to bring the engaging portion 30 into engagement with the catching portion 31 when the upper casing 3 is assembled with the lower casing 4 together with the tongue 29, which facilitates assembling of the tape cartridge.

Figure 6:
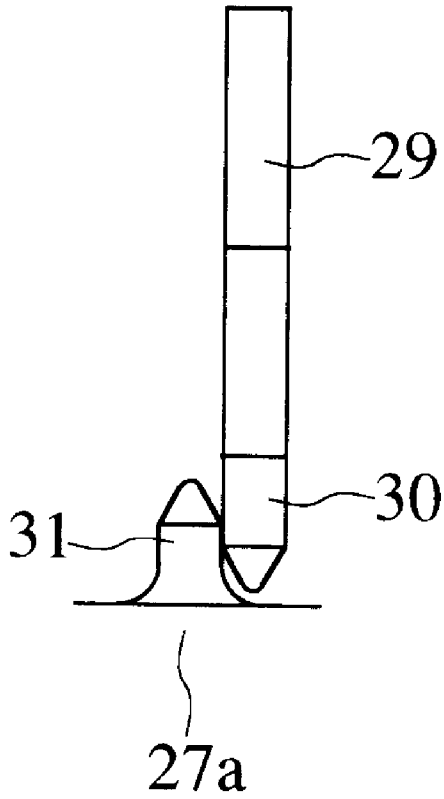
FIG. 6 is a side elevation of a rotation stop mechanism.

Further, as shown in FIG. 6, the engaging portion 30 and the catching portion 31 have ends shaped like respective acute ridges extending in a direction transverse to the direction of rotation of the spool 21. The ridge-like ends of the engaging portion 30 and the catching portion 31 facilitate assembling of the upper casing 3 and its tongue 29 with the lower casing 4. That is, even if the engaging portion 30 strikes against the catching portion 30 during assembly work, the sliding-contact member 25 is caused to rotate to thereby get the catching portion shift in rotational position to permit the engaging portion 30 to be inserted to its proper depth. That is, the engaging portion 30 and the catching portion 31 can be brought into a properly engaged state without difficulty, simply through fitting the upper casing 3 on the lower casing 4.

As described heretofore, according to the present embodiment of the invention, the coiled spring 26 which is long in spring stroke and at the same time has a small spring constant is employed as a spring for braking the rotation of the spool 21, whereby it is possible to attain a stable braking force, and apply back tension which is constant, i.e. with very little variation, to the ink ribbon R rolled out from the spool 21. Further, by changing the length of the coiled spring 26, the magnitude of the back tension can be adjusted to the ink ribbon R and a drive system for feeding the same. Further, since the coiled spring 26 is arranged in the hollow portion 24 of the spool 21 in a state received in the spring-receiving portion 27, it is possible to minimize the height of the casing 2.

Further, it goes without saying that the tape reel device of the present embodiment can be applied to cartridges accommodating tape materials for use in various electronic devices.

As described heretofore, according to the tape reel device and the tape cartridge incorporating the same of the invention, a spring is arranged within a hollow portion of a spool for urging a sliding-contact member, so that it is possible to reduce variation of the urging force acting on the spool during rotation and stabilize the braking force applied to the spool without increasing the height of the casing of the cartridge. This makes it possible to apply constant back tension to the tape material rolled out, and hence prevent the ink ribbon R from being loosened without increasing load on the drive system for feeding the ribbon R.

It is further understood by those skilled in the art that the foregoing are preferred embodiments of the invention, and that various changes and modification may be made without departing from the spirit and scope thereof.

What is claimed is:

1. A tape reel device comprising:

a supply spool having a cylindrical shape defining a hollow interior, the supply spool having a first end, a second end, and a shoulder surface near the first end, the shoulder surface being substantially perpendicular to an axial direction of the supply spool;

a casing rotatably accommodating the supply spool, the casing having a first portion disposed adjacent the first end of the supply spool;

a sliding-contact member disposed substantially within the hollow interior of the supply spool and defining a hollow spring-receiving space, the sliding-contact member having a flange portion disposed near the first end of the supply spool and being in sliding contact with the shoulder surface; and a spring disposed within the hollow spring-receiving space of the sliding-contact member between the shoulder surface and the second end of the supply spool, the spring engaging the first portion of the casing and the sliding-contact member to urge the flange portion against the shoulder surface of the supply spool.

2. The tape reel device of claim 1, wherein the casing further comprises a rotation stop mechanism for preventing the rotation of the sliding-contact member.

3. The tape reel device of claim 2, wherein the rotation stop mechanism comprises an engaging portion extending into the hollow spring-receiving space, and a catching portion formed on a surface of the sliding-contact member, the engaging portion and the catching portion engage each other in the direction of rotation of the supply spool.

4. The tape reel device of claim 3, wherein the engaging portion and the catching portion each has an end having the shape of an acute ridge extending in a direction transverse to the direction of rotation of the supply spool.

5. The tape reel device of claim 1, wherein the spring is a coiled spring and is disposed substantially coaxially with the supply spool.

6. The tape reel device of claim 1, wherein the flange portion contacts the shoulder surface in a entire circumference of the flange.

7. The tape reel device of claim 1, wherein the shoulder surface and the flange portion are made of resin.

8. The tape reel device of claim 1, wherein the supply spool further has an annular protrusion extending axially at the first end and radially surrounding the flange portion of the sliding-contact member, and wherein the flange portion and the annular protrusion cooperate to rotatably support the supply spool.

9. The tape reel device of claim 8, wherein the casing comprises a shaft portion disposed in the hollow spring-receiving space of the sliding-contact member for supporting the sliding-contact member.

10. A tape reel device comprising:

a supply spool having a cylindrical shape defining a hollow interior, the supply spool having a first end, a second end, a shoulder surface near the first end, and an annular protrusion extending axially at the first end, the shoulder surface being substantially perpendicular to an axial direction of the supply spool;

a casing rotatably accommodating the supply spool, the casing having a first portion disposed adjacent the first end of the supply spool;

a sliding-contact member disposed substantially within the hollow interior of the supply spool and defining a hollow spring-receiving space and having a flange portion disposed near the first end of the supply spool, the flange portion being in sliding contact with the shoulder surface and radially surrounded by the annular protrusion, the flange portion and the annular protrusion cooperate to rotatably support the supply spool; and a spring disposed within the hollow spring-receiving space of the sliding-contact member between the shoulder surface and the second end of the supply spool, the spring engaging the first portion of the casing and the sliding-contact member to urge the flange portion against the shoulder surface.

11. The tape reel device of claim 10, wherein the casing further has a shaft portion disposed in the hollow spring-receiving space of the sliding-contact member for supporting the sliding-contact member.

* * * * *

UNITED STATES PATENT AND TRADEMARK OFFICE

CERTIFICATE OF CORRECTION

PATENT NO. : 6,042,039

DATED : Mar. 28, 2000

INVENTOR(S) : Yoshikiyo Furuya, et al

It is certified that error appears in the above-identified patent and that said Letters Patent is hereby corrected as shown below:

On title page, item [73] should read as follows:

[73] Assignee: Seiko Epson Corporation, Tokyo, Japan; King Jim Co., Ltd., Tokyo, Japan Signed and Sealed this Eighth Day of August, 2000

*Attest:*

*Attesting Officer*

Q. TODD DICKINSON

*Director of Patents and Trademarks*